United States Patent [19]

Eid

[11] 3,939,600

[45] Feb. 24, 1976

[54] TAKE-APART TOY

[76] Inventor: Ellen G. Eid, 15666 SE. Johnson Road, Clackamas, Oreg. 97015

[22] Filed: Oct. 30, 1974

[21] Appl. No.: 519,258

[52] U.S. Cl. ..... 46/17

[51] Int. Cl.[2] ..... A63H 33/06

[58] Field of Search ..... 46/16, 17, 76 R, 201

[56] References Cited

UNITED STATES PATENTS

| | | | |
|---|---|---|---|
| 916,243 | 3/1909 | Wing | 46/17 |
| 1,462,244 | 7/1923 | Piper et al. | 46/76 R |
| 1,674,637 | 6/1928 | Conway | 46/76 R |
| 1,804,927 | 5/1931 | Gilbert | 46/16 |
| 2,332,718 | 10/1943 | Hickling | 46/17 |
| 2,360,030 | 10/1944 | Hickling | 46/16 |
| 2,382,982 | 8/1945 | Elliott | 46/16 |
| 2,446,770 | 8/1948 | Kershisnik | 46/16 |
| 2,545,155 | 3/1951 | Logan | 46/17 |
| 2,568,557 | 9/1951 | Newbery | 46/17 |
| 3,528,193 | 9/1970 | Yamakawa | 46/17 |

FOREIGN PATENTS OR APPLICATIONS

| | | | |
|---|---|---|---|
| 605,652 | 7/1948 | United Kingdom | 46/17 |
| 506,842 | 6/1939 | United Kingdom | 46/17 |

*Primary Examiner*—Louis G. Mancene
*Assistant Examiner*—J. Q. Lever
*Attorney, Agent, or Firm*—Chernoff & Vilhauer

[57] ABSTRACT

A take-apart wooden toy which, when assembled, variably resembles any of a number of different devices. Such toy comprises a kit, having a number of interchangeable parts and common characteristics, designed to be taken apart and assembled by a young child and including the following common parts: at least one body member with circular apertures or threaded sockets which defines the assembled toy's shape and character; standard bolts or studs with threaded portions on both ends thereof and a smooth portion in between; standard nuts for mating with the bolts; and a plurality of accessory members of different types for further defining the shape of the assembled device. The accessory members may include axle members and standard wheels which fit rotatably on the bolts, and elongated bar members which fit loosely on the bolts or studs. All of the parts preferably are made of wood and each of the bolts has the same diameter and the same size thread for engaging either the wooden nuts or threaded sockets in the body member.

4 Claims, 10 Drawing Figures

TAKE-APART TOY

BACKGROUND OF THE INVENTION

This invention relates to take-apart toys, particularly wooden toys which may be variably assembled to resemble a variety of different devices such as a cart, truck, locomotive, airplane, motorcycle and the like.

It has been recognized by the Applicant that while the tendency of children to disassemble their toys is ordinarily destructive, this propensity can be utilized constructively to provide both education and entertainment for a child through the use of toys naturally suitable for disassembly and reassembly. Although other people have recognized the same possibility and have accordingly designed take-apart toys to achieve these goals, none of the prior art toys provides the combination of simplicity, definition of form, and versatility recognized by the Applicant as needed.

Hickling U.S. Pats. 2,332,718 and 2,360,030 disclose a take-apart, wooden toy train held together by means of pins completely threaded throughout their length and nuts for engaging the pins. Similarly, the wheels of the train are secured to the body by threaded axles and associated nuts. However, the structure of the toy disclosed in Hickling is specifically designed to resemble a train and there is no suggestion that the parts thereof would be interchangeable with toys resembling a variety of other devices; thus the educational value of the Hickling toys is limited in this respect. In particular the threaded axles of Hickling are not detachable and the completely threaded pins have limited application since their central portions are not smooth, thereby limiting the versatility and interchangeability of the parts.

SUMMARY OF THE INVENTION

In view of the deficiencies of present take-apart toys, there is a need for such a toy employing some common, universally interchangeable parts which may be joined with other non-universal special parts to resemble a variety of different devices, wherein the form of the device resembled is realistically defined, yet the toy is simple in design for easy manipulation and understanding by a very young child. The present invention achieves this goal and overcomes the drawbacks of the aforementioned prior art toys by providing a toy utilizing a number of standard interchangeable parts in conjunction with one or more unique non-universal principal body members, each of the latter defining the basic character and form of a different particular device.

Such toy, depending upon how assembled, resembles one of a variety of devices such as a cart, truck, locomotive, airplane, motorcycle, etc.; all such toys have universally interchangeable parts and common characteristics; and they all are designed to be taken apart and assembled by a very young child. The toy includes at least one non-universal principal body member with circular apertures or threaded sockets, standard bolts or studs with threaded portions on both ends thereof, standard nuts for mating with the bolts, and various interchangeable, universal accessory members. The accessory members include axle members and wheels which fit rotatably on the bolts, and elongated bar members which fit loosely on the bolts or studs.

The bolts, bar members, and wheels may each be provided in sets of different standard sizes which facilitates the interchangeability of such parts between various assembled devices. The diameter and thread of each bolt are each identical. Each of the elongated bar members has a non-threaded circular aperture in each end thereof, the size of the aperture being slightly larger than the diameter of the bolts so that the bolts fit loosely therein. Similarly, the wheels have a central circular aperture the size of which is such that the wheels fit loosely and rotatably on the bolts. The difference between the various sizes of bolts and bar members is in their length, and the difference between the various size wheels is in their diameter. The flexibility in function of the bolts is aided by their non-threaded, smooth central portions which can be used to resemble a cart stake airplane wing support or other structural member, and which provides a bearing surface for a rotating wheel.

All of the parts of the toy are held together by the standard bolts which engage a standard nut or a threaded socket in the principal body member unique to the toy. This singular, simple fitting makes the toy easy to use by a very young child, yet it is similar to the nut and bolt-type fittings used in the devices which the toys resemble. Consistent therewith, all of the parts are preferably relatively large and simple in design, for example the nuts should be square, so that they are easy to handle and understand by a very young child. Also the parts should preferably be made of wood so that they are solid yet somewhat lightweight and durable.

It is therefore a principal object of this invention to provide a new and improved take-apart toy which can be disassembled and reassembled by a very young child for entertainment and educational purposes.

It is a further object of the present invention to provide such a take-apart toy which may be variably assembled to resemble realistically a plurality of different devices and which employs some universally interchangeable parts applicable to any of several of the different devices.

It is yet another object of the present invention to provide such a take-apart toy having one or more special non-interchangeable principal body members clearly defining the shape and character of each device to be resembled, such principal body members being adapted for use in combination with the universally interchangeable parts.

The foregoing and other objects, features, and advantages of the invention will be more readily understood upon consideration of the following detailed description of the invention, taken in conjunction with the accompanying drawings.

DESCRIPTION OF THE PREFERRED EMBODIMENT

Figure 1:
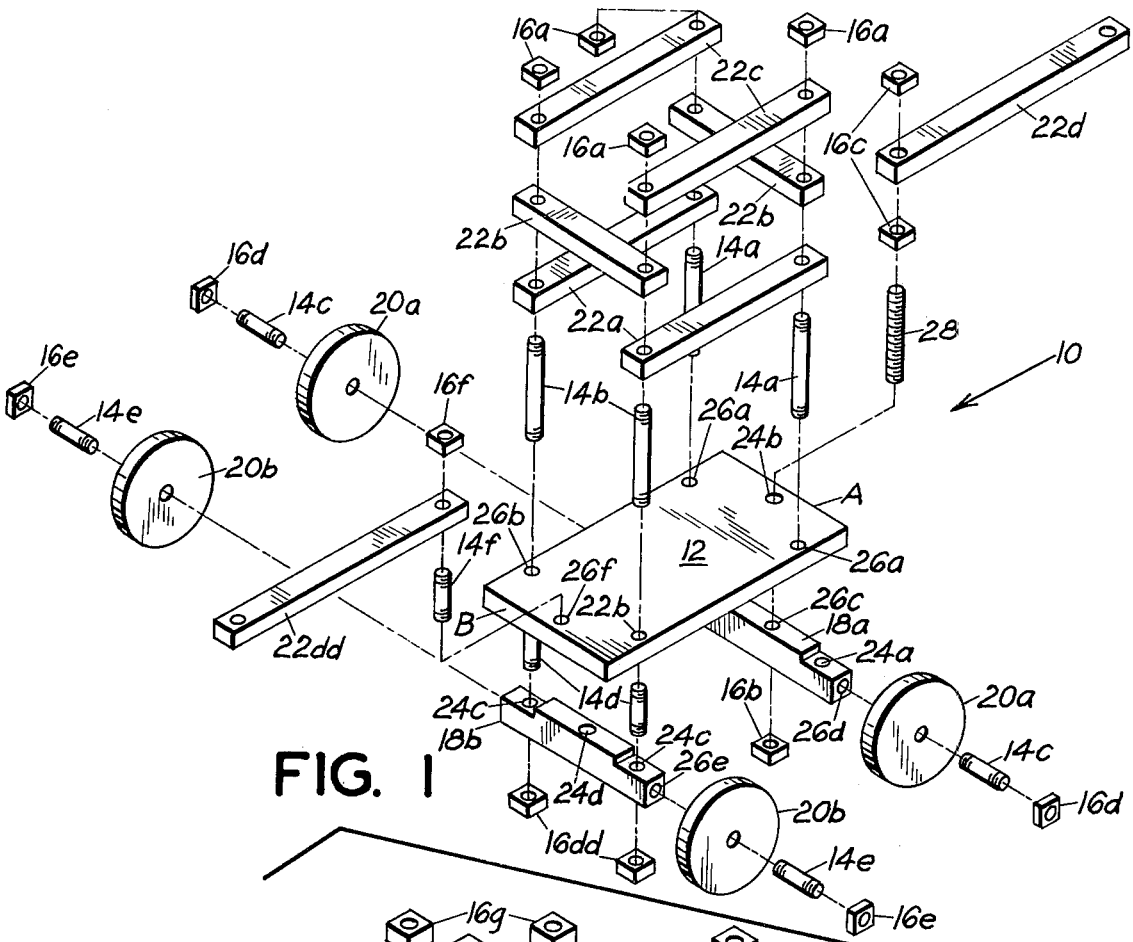
FIG. 1 is an exploded view of a cart embodiment of the present invention.

The toy described herein comprises a kit of a set of parts, some of which are common to all of the different assembled embodiments possible, and others of which are included in only some of the embodiments. In addition, all of the different assembled embodiments include at least one principal body member which defines the nature of the device which the particular embodiment is intended to resemble by providing it with a basic shape. For example, referring to FIG. 1, the basic shape of the cart toy 10 is defined by the platform-like rectangular base 12. However, the toy also includes several standard universal bolts 14 having separate threads at each end thereof with a smooth portion in between, and a number of standard universal nuts 16, preferably square, for fastening on the ends of the bolts. (For purposes of explanation a numeric symbol herein refers to any one of a type of part, whereas an alphanumeric symbol refers to a specific one of the group of parts referred to by the numeric portion of the symbol.) For the sake of simplicity the outside diameter of the threaded diameter of the threaded portions of the bolts is the same as the diameter of the non-threaded portion. These three parts, that is, a principal body member, one or more standard bolts and one or more standard nuts are common to all of the toys described herein. The cart toy also includes axle members 18, wheels 20, and elongated bar members 22, having non-threaded circular apertures 24 disposed in each end thereof, each of which are common to several of the toys. Although some elongated bar members may be slightly modified for a particular toy, they generally are relatively long and thin, in the shape of a right rectangular prism, each of the faces of the prism forming a right angle at its intersection with another. All of the toys are assembled by insertion of the bolts in either non-threaded apertures 24 or circular apertures 26 having interior threads, the non-threaded apertures being of a size for loosely receiving the bolts and the other apertures being threaded for matingly receiving the threaded ends of the bolts, and by securing the parts together with standard nuts screwed onto the ends of the bolts. It should be recognized that the standard bolts, elongated bar members and wheels are to be made in various standard sizes and shapes for serving a variety of purposes and that the threads of all the various threaded parts are identical. Since the size required of any standard part will depend upon its particular use and is not generally critical to the novelty of this invention, no distinction is made herein as to the dimensions of the parts except where the dimensions are peculiarly important to the particular toy.

Turning now specifically to the cart toy 10 shown in FIG. 1, the shape of the toy is further defined by two bolts 14*a* matingly inserted in a corresponding pair of threaded apertures 26*a* adjacent the sides and front end A of the base 12 thereby representing upright posts or stakes. Similarly, another pair of bolts 14*b* are inserted in a corresponding pair of threaded apertures 26*b* adjacent the sides and rear end B of the base. The bolts 14*a–b* are spaced apart a longitudinal distance such that bar members 22*a* will fit loosely over two bolts 14*a* and 14*b* adjacent the same side. Similarly, the bolts of each pair 14*a–b* are spaced apart a lateral distance such that bar members 22*b* will fit loosely over them. A further pair of bar members 22*c* may be placed on the bolts 14*a–b* after the bar members 22*b* have been placed thereon if desired. Standard nuts 16*a* are placed on the upper end of each bolt 14*a–b* to retain the bar members 22*a–c* thereon. Thus, the side walls of the cart are defined by the bar members, bolts and nuts attached to the base.

In order to provide a set of front wheels for turning the cart, an axle member 18*a* having a non-threaded aperture 24*a* placed through the top thereof adjacent each end, a threaded aperture 26*c* centrally placed through the top thereof, and threaded apertures 26*d* placed in each end thereof is attached to the underside of the base 12 by a completely threaded bolt 28, having the standard diameter and thread size, which is matingly inserted in the axle's threaded aperture 26*c* and fixedly secured to the axle by a standard nut 16*b*. The bolt 28 extends through a non-threaded aperture 24*b* centrally disposed adjacent the front end of the base 12 and is inserted in the end of a bar member 22*d* serving as a leading coupling or handle above the base 12 and fixedly sandwiched between a pair of nuts 16*c* tightened against the bar member for turning the axle 18*a* and steering the cart 10. A pair of wheels 20*a* are attached to each end of the axle 18*a* by bolts 14 *c* matingly inserted in the ends of the axle and secured by standard nuts 16*d*.

In addition, a fixed axle member 18*b* having two non-threaded apertures 24*c* placed through its top, one adjacent each end, one non-threaded aperture 24*d* centered, and a threaded aperture 26*e* placed in each end thereof, is attached to the underside of the base 12 near the rear end B by a pair of bolts 14*d* inserted through the threaded apertures 24*c* from the underside of base 12 into the rearmost threaded apertures 26*b* and secured by standard nuts 16*dd*. A pair of wheels 20*b* are attached to each end of axle member 18*b* by bolts 14*e*, and secured by a standard nut 16*e*.

In order to provide a rear hitch for connecting the leading coupling of one cart to the rear of another, a threaded aperture 26*f* is centrally placed adjacent the rear end B of base 12. A bar member 22*dd*, which serves as the leading coupling or handle of another cart in a series of carts, is pivotally attached to the rear of the cart by a bolt 14*f* matingly inserted in the aperture 26*f* and the bar member 22*dd* is secured by a nut 16*f*.

Figure 2:
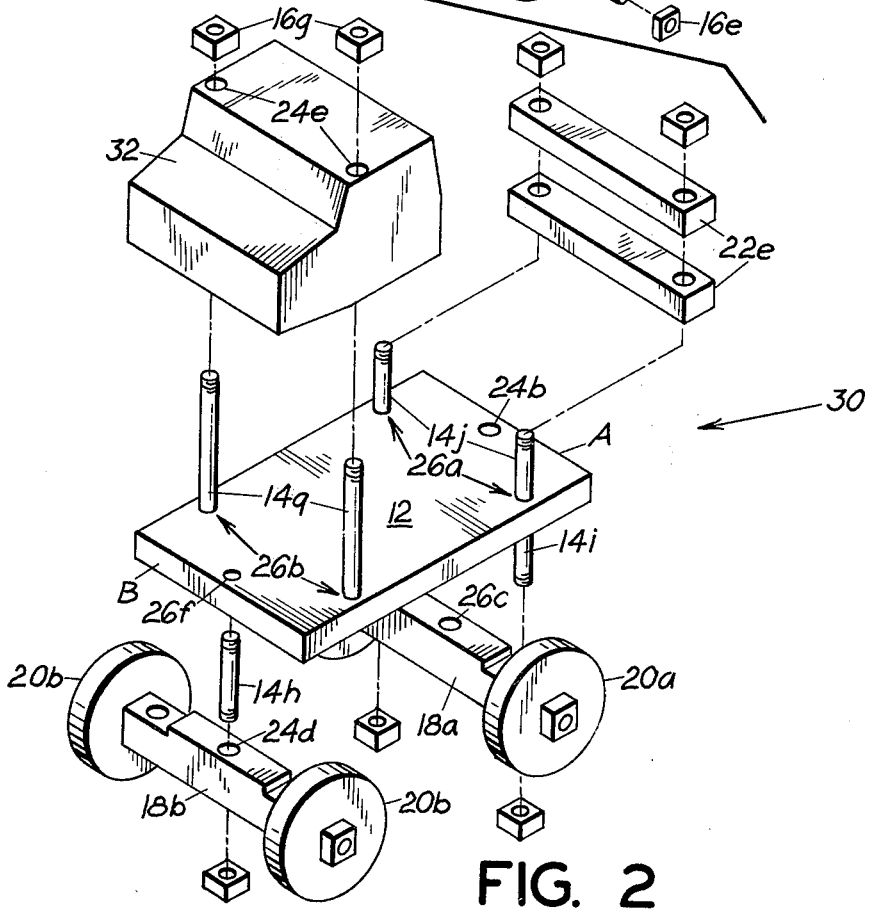
FIG. 2 is an exploded view of a truck embodiment of the present invention.

Referring to FIG. 2, the take-apart truck embodiment 30 utilizes the same base 12 as a principal body member and axle members 18*a–b* accompanied by wheels 20*a–b* attached thereto as the cart toy 10. However, a cab 32 is attached to the top of base plate 12 by a pair of bolts 14*g* placed through non-threaded apertures 24*e* and inserted into the threaded apertures 26*b* and secured by a pair of nuts 16*g* as an additional principal body member for defining the shape and nature of the toy.

While the front end A of the base 12 is also the front end of the cart toy 10, in this case the front end of the truck toy is the rear end B of the base 12. Accordingly, in order to provide a turning front axle for guiding the truck toy, the axle member 18*b* is pivotally attached to the underside of the base 12 by a bolt 14*h* inserted into the threaded aperture 26*f* adjacent the rear end B of the base 12 and through the non-threaded aperture 24*d* of the axle member and secured by a standard nut. In this manner the axle 18*b* is mounted to rotate freely on the bolt.

On the other hand, the axle member 18*a* is now attached to the underside of the base 12 by a pair of bolts 14*i* inserted through its non-threaded apertures 24*a* (see FIG. 1) and from the underside into the threaded apertures 26*a* in the base 12. In addition, if desired, a pair of bar members 22*e* may be attached to the base of the truck by a pair of bolts 14*j* inserted from the top into the threaded apertures 26*a*. Also, another assembled toy may be attached for pulling by a bolt placed in the nonthreaded aperture 24*b* in base 12; for example, the cart toy 10 may be attached by its leading coupling, bar member 22*d* (see FIG. 1).

Figure 3:
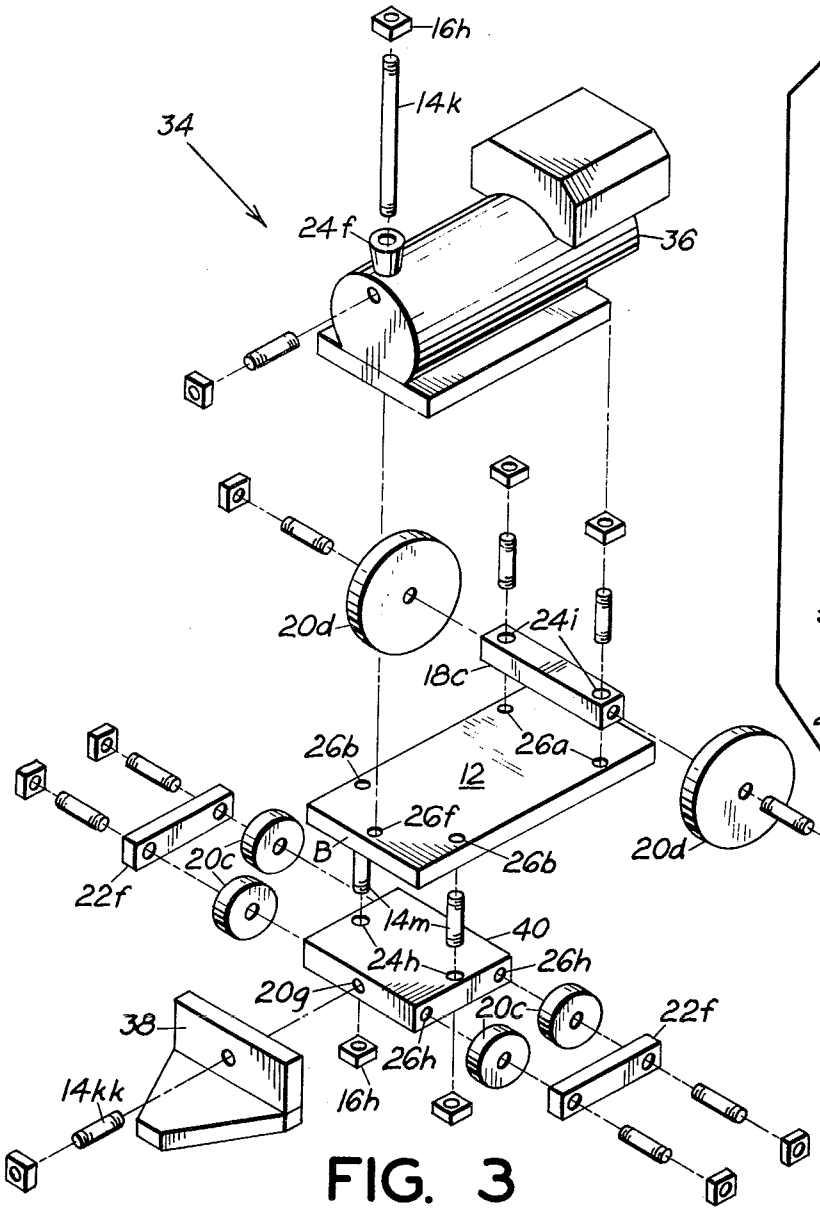
FIG. 3 is an exploded view of a locomotive embodiment of the present invention.

Turning now to FIG. 3, the locomotive toy 34 also utilizes base 12 as a principal body member with a number of associated parts attached thereto. A cab and boiler member 36 and a cowcatcher 38 are attached to base 12 as additional principal body members giving the toy the shape of a locomotive; and, as with the truck toy, the front end of the locomotive is the rear end B of base 12.

The cab and boiler member 36 is attached to the top of base 12 by a bolt 14*k* inserted through a non-threaded aperture 24*f* in the top of the cab and boiler member and into the threaded aperture 26*f* adjacent the rear end B of base 12. A standard nut 16*h* secures the cab and boiler member to the base. The cowcatcher 38 is attached indirectly to base 12 through a dual axle 40. The cowcatcher is attached to the front of the dual axle by a bolt 14*kk* inserted in a threaded aperture 26*g* in the dual axle, and secured by a nut. The dual axle is in turn attached to the base 12 by a pair of bolts 14*m* inserted through a corresponding pair of non-threaded apertures 24*h* and into the threaded apertures 26*b* in the base 12.

As a representation of guide wheels, a pair of wheels 20*c* are attached to each side of the dual axle 40 by a respective pair of bolts matingly inserted in threaded apertures 26*h* and secured by standard nuts. A bar member 22*f* is attached between the two wheels of each respective pair. This dual axle having two pairs of wheels is common to several of the toys disclosed herein. Drive wheels are represented by two wheels 20*d* attached to the rear of the locomotive by an axle member 18*c*. As with the cart and the truck the wheels are rotatably attached to the ends of the axle member 18*c* by bolts and nuts, and the axle member is attached to the base 12 by bolts which are inserted through non-threaded apertures 24*i* adjacent the ends thereof and inserted into the threaded apertures 26*a* in base 12. This axle also serves to prevent the cab and boiler member 36 from rotating about the bolt 14*k* by which it is mounted.

Figure 4:
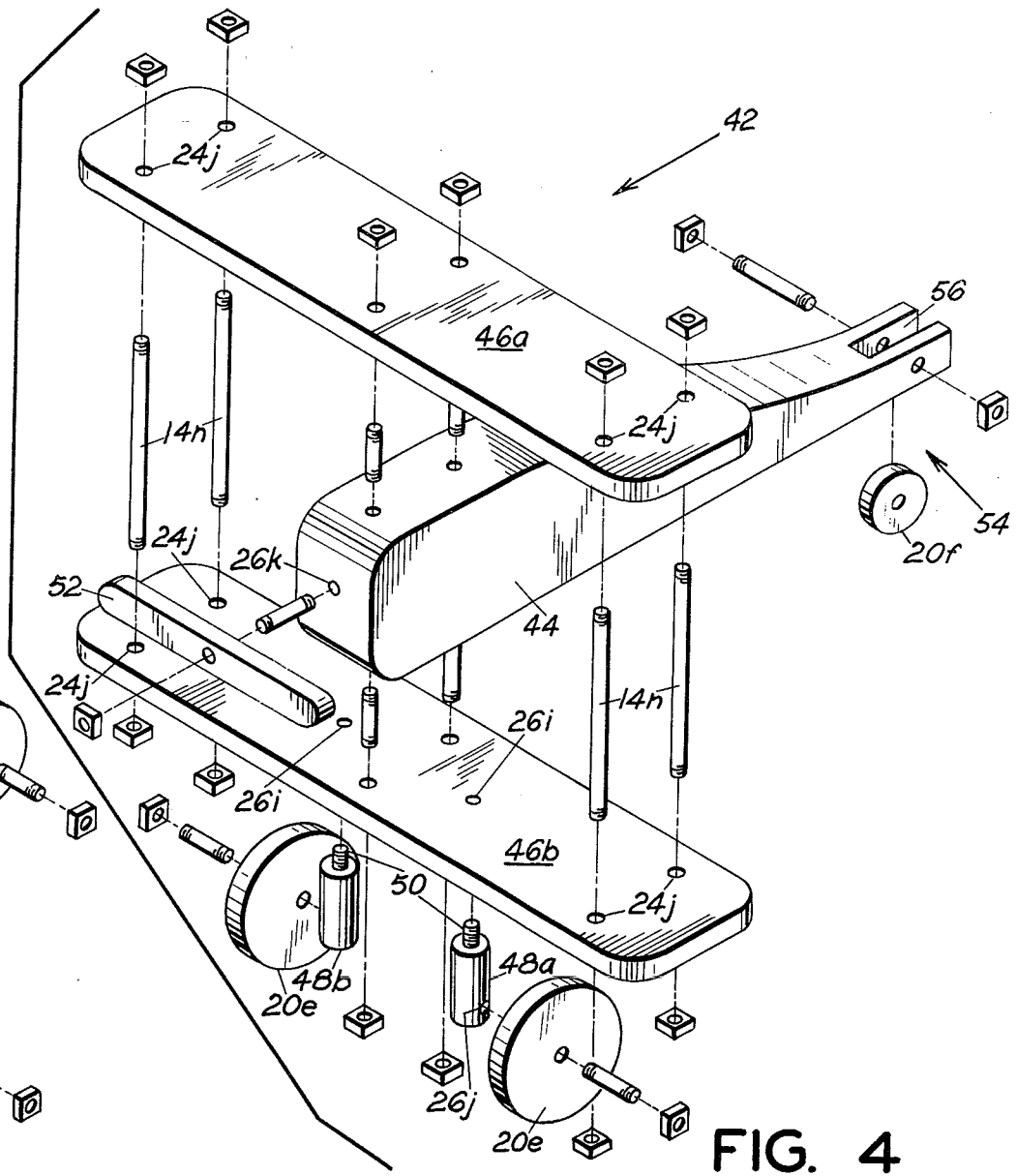
FIG. 4 is an exploded view of an airplane embodiment the present invention.

In contrast to the previously described toys, the airplane embodiment 42 shown in FIG. 4, utilizes a fuselage 44 as its principal body member. It also utilizes slightly modified elongated bar members in the form of a pair of wings 46*a* and 46*b* attached respectively to the top and bottom of the fuselage by respective pairs of bolts. Furthermore, it utilizes a slightly different kind of axle member in the form of a pair of wheel supports 48*a* and 48*b* simulating landing gears attached to the underside of the bottom wing 46*b* by threaded portions 50 matingly inserted in the threaded apertures 26*i*. The wheel supports include threaded apertures 26*j* in their sides for attachment of respective wheels 20*e*.

The toy's resemblance to an airplane is further enhanced by a propeller 52 rotatably attached to the front of the fuselage by a standard bolt inserted in a threaded aperture 26*k*, and two pairs of bolts 14*n* are disposed between the non-threaded apertures 24*j* at the ends thereof and secured by standard nuts, representing wing supports. Finally, a wheel 20*f* is attached to the tail 54 of the plane toy in a fork-like slot 56 by a standard bolt and a pair of standard nuts.

Figure 5:
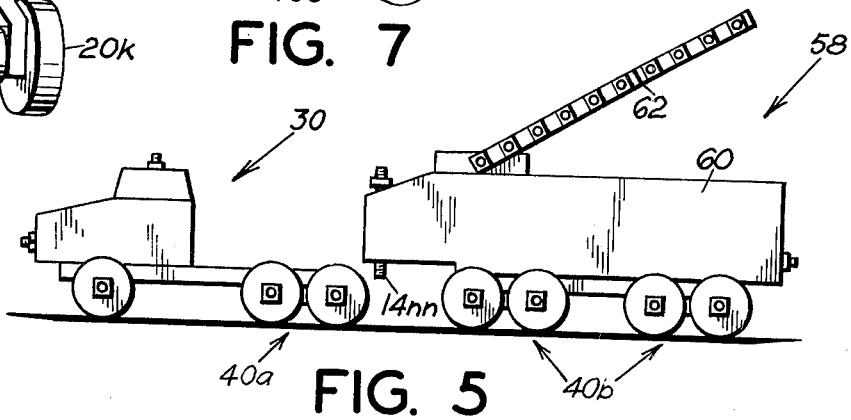
FIG. 5 is a perspective view of a truck and trailer embodiment of the present invention.

The truck and trailer embodiment 58, shown in FIG. 5, basically comprises a modified truck toy 30 (see FIG. 2) with a trailer attached. In this case the truck toy utilizes a dual axle 40*a* attached to its rear rather than the single axle as shown in FIG. 2. The trailer comprises a trailer body 60 having a pair of dual axles 40*b* attached to the bottom thereof and being pivotally attached to the rear of the truck 30 by a standard bolt 14*nn*. Alternatively the truck and trailer can be converted to a fire engine by adding the ladder 62.

Figure 6:
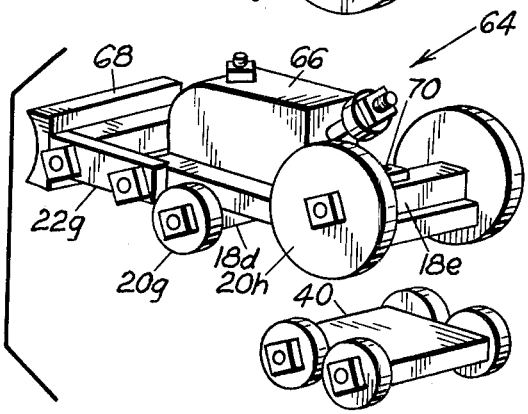
FIG. 6 is a perspective view of a tractor embodiment of the present invention.

The tractor embodiment 64 shown in FIG. 6 basically comprises a tractor body 66 having a blade 68 attached to the front thereof by a pair of standard elongated bar members 22*g* and standard nuts and bolts. The tractor is supported by two pairs of wheels 20*g* and 20*h* mounted respectively on axle members 18*d* and 18*e* attached to the body 66. The axle member 18*e* is attached to the top rear of the tractor body and a seat 70 may be attached thereto. Alternatively, a dual axle 40 may be attached to the rear of the tractor to simulate a crawler-type tractor.

Figure 7:
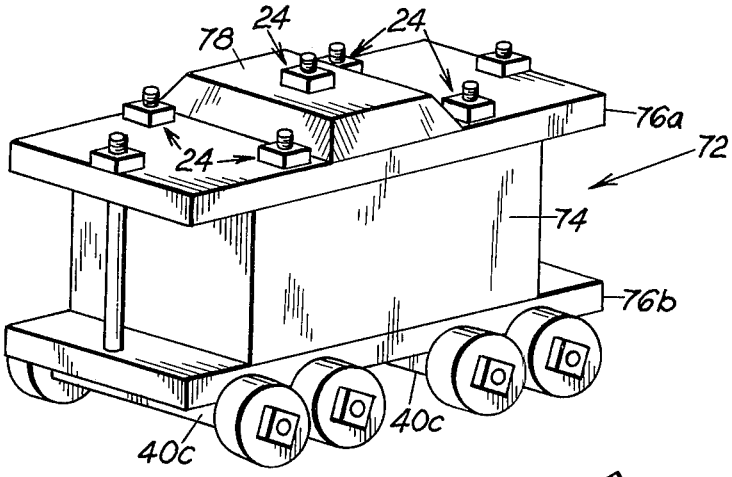
FIG. 7 is a perspective view of a caboose embodiment of the present invention.

In FIG. 7 the railroad caboose embodiment 72 utilizes an interior compartment member 72 sandwiched between two slightly modified elongated bar members 76*a–b* to define its basic shape. In this case, as with the airplane toy, the elongated bar members 76 are relatively wider than in most of the other toys in order to simulate the top and bottom of a caboose and non-threaded apertures 24 are included at points other than the ends. Also an observation member 78 is attached to the top of the caboose and a pair of dual axles 40*c* along with wheels are attached to the bottom.

Figure 8:
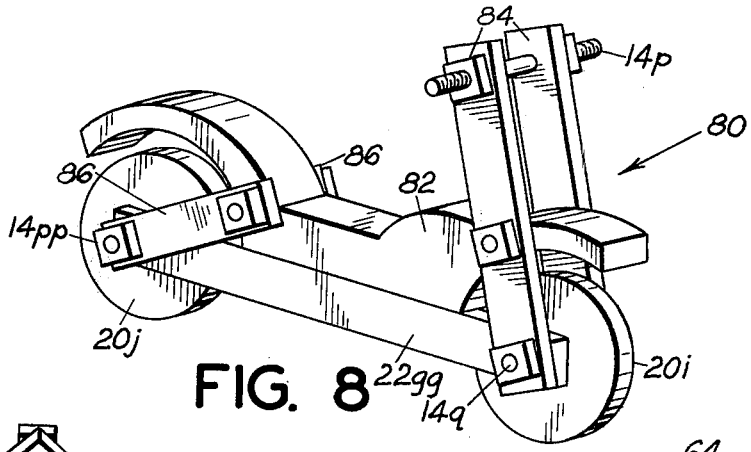
FIG. 8 is a perspective view of a motorcycle embodiment of the present invention.

Referring now to FIG. 8, the principal body member of the motorcycle embodiment 80 is a frame 82. In this case a unique pair of front axle members 84 attached to the frame 82 also serve as supports for the bolt 14*p* which simulates handle bars. A pair of elongated bar members serve a dual function as rear axle members 86. In addition, a pair of elongated bar members 22*gg* are affixed between the two wheels 20*i* and 20*j* supported respectively by the front and rear axle members through which bolts 14*pp* and 14*q* are placed.

Figure 9:
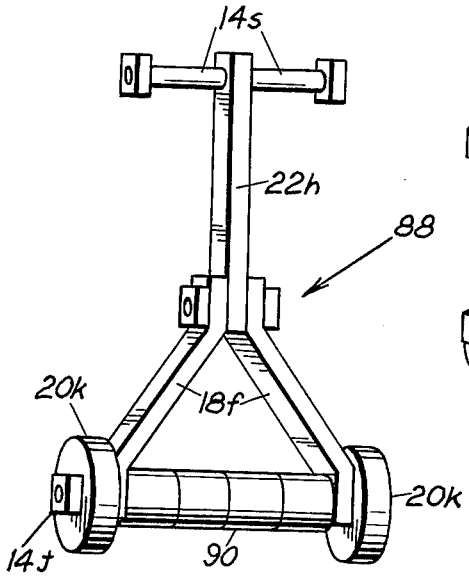
FIG. 9 is a perspective view of a lawn chair embodiment of the present invention.

Similarly, the axle members 18*f* of the lawn mower embodiment 88 shown in FIG. 9 are somewhat different in that they form a fork-like support for a pair of wheels 20*k* and a blade-simulating principal body member, cylinder 90. Each axle 18*f* comprises a bar-like member with bends at each end so that they may be joined closely together at one end yet are wide apart at the other end while both ends of each bar remain parallel to the respective ends of the other bar thereby producing a fork within which the cylinder 90 may be held. An elongate bar member 22*h* which supports a pair of bolts 14*s* simulating a handle is attached to the narrow end of the fork where the two axle members are joined, and the wheels 20*k* and cylinder 90 are rotatably attached to the wide end of the fork by a standard bolt 14*t*.

Figure 10:
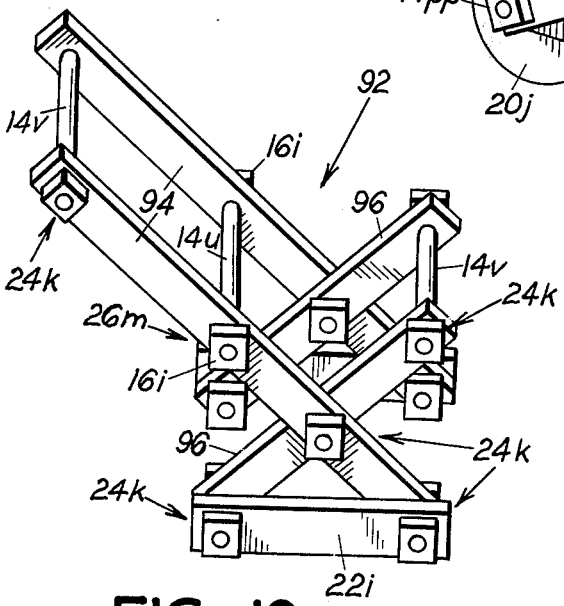
FIG. 10 is a perspective view of a lawn chair embodiment of the present invention.

Turning now to FIG. 10, the principal body members of the lawn chain 92 are a pair of elongated back members 94 having three non-threaded apertures 24*k* and one threaded aperture 26*m* disposed therein, and a pair of elongated front members 96 having three non-threaded apertures 24*k* disposed therein. Each front member crosses a back member at a common non-threaded aperture 24*k* and they are attached to one another at their crossing point by standard nuts and bolts. Also, they are joined together at their lower ends by a standard elongate bar member 22*i*. In order to form a chair frame the two pairs of crossed front and back members are held parallel to one another by a standard bolt 14*u* matingly inserted in the threaded apertures 26*m* and secured thereto by standard nuts 16*i*. A pair of additional bolts 14*v* provide support for a seat cover.

The terms and expressions which have been employed in the foregoing abstract and specification are used therein as terms of description and not of limitation, and there is no intention in the use of such terms and expressions, of excluding equivalents of the features shown and described or portions thereof, it being recognized that the scope of the invention is defined and limited only by the claims which follow.

What is claimed is:

1. A take-apart toy whose parts may be assembled to resemble one or more particular devices, comprising:

a. a rectangular base having a pair of threaded circular side apertures extending through said base along each side thereof and a circular aperture extending through said base adjacent each end thereof, one said end aperture having interior threads;

b. a plurality of round bolts, each of a sufficiently small diameter for insertion into at least one said circular apertures in said rectangular base, said bolts having two separate sets of threads each disposed at the respective ends thereof and a smooth surface portion disposed therebetween, the outside diameter of the threaded portions of said bolts being substantially equal to the diameter of the smooth portion and the threads of said bolts being matingly matched to the threads of said threaded apertures in said rectangular base, the end aperture in said base opposite said threaded end aperture being of sufficient size for slidably accepting one of said bolts;

c. a plurality of nuts having interior threads for mating with the threads of said bolts;

d. a plurality of wheels each having a circular aperture of a diameter larger than the diameter of said bolts formed at its center for rotatably mounting said wheels on said bolts; and e. multiple elongate axle members for attachment to said rectangular base to support said wheels, each said axle member having threaded apertures formed longitudinally at each end thereof for mating with the threads of one of said bolts and multiple longitudinally spaced apertures extending transversely through said elongate member each of a diameter larger than that of said bolts for slidably accepting said bolts, the longitudinal spacing between said transverse apertures in said axle members being equal to the side-to-side spacing between said two pairs of side apertures in said rectangular base to permit said respective apertures to align with one another.

2. The take-apart toy of claim 1 wherein a first one of said axle members has a threaded aperture formed at its midpoint for mating with the threads of said bolts, and a second one of said axle members has a circular aperture formed at its midpoint of suitable size for slidably receiving one of said bolts.

3. The take-apart toy of claim 1 further comprising a member having the shape of a truck cab and having apertures extending vertically through the sides thereof with a side-to-side spacing equal to that between said two pairs of side apertures in said rectangular base, so as to permit said respective apertures to align with one another.

4. The take-apart toy of claim 1 further comprising a plurality of elongate bar members each having a circular aperture formed transversely through each end thereof of a diameter larger than said bolts for slidably accepting said bolts, the longitudinal spacing between said apertures in at least some of said bar members being equal to the side-to-side spacing between said two pairs of side apertures in said rectangular base.

* * * * *